United States Patent [19]

Bugnone

[11] 4,200,245

[45] Apr. 29, 1980

[54] WEB FEEDING OR WINDING-UP APPARATUS

[76] Inventor: Aldo Bugnone, Via Bellini 2, Turin, Italy

[21] Appl. No.: 912,149

[22] Filed: Jun. 2, 1978

[30] Foreign Application Priority Data

Jun. 2, 1977 [IT] Italy ..... 68265 A/77

[51] Int. Cl.[2] ..... B65H 17/02; B65H 19/06; B65H 25/26

[52] U.S. Cl. ..... 242/64; 242/57.1; 242/68.4

[58] Field of Search ..... 242/68.4, 64, 57.1, 242/58, 58.6, 79, 81, 68, 56 A, 129.6, 129.62, 67.1 R

[56] References Cited

U.S. PATENT DOCUMENTS

| | | | |
|---|---|---|---|
| 1,208,418 | 12/1916 | Walser et al. | 242/58 |
| 1,750,487 | 3/1930 | Okuura | 242/64 X |
| 3,075,719 | 1/1963 | Hornstein et al. | 242/68.4 X |
| 3,368,769 | 2/1968 | Obenshain | 242/68.4 |
| 3,486,708 | 12/1969 | Lamon | 242/64 X |
| 3,931,940 | 1/1976 | Raighn et al. | 242/57.1 |
| 4,077,579 | 3/1978 | Seleski et al. | 242/57.1 |

*Primary Examiner*—John M. Jillions

*Attorney, Agent, or Firm*—Sughrue, Rothwell, Mion, Zinn and Macpeak

[57] ABSTRACT

A device for feeding or winding up a web to or from a web using machine such as a web printing machine or a painting, coating, spreading or laminating machine, comprises two lateral uprights carrying one or two pairs of arms which are turnable about substantially horizontal axes and which carry at their free ends means for mounting the ends of a core on which a roll of web is or is to be wound, one of the arms carrying a drive motor for driving the core to rotate to wind-up or feed off web from the roll; the arms are hollow box section elements and the motor is housed within the interior which can also be provided with a brake and with means for circulating cooling air.

4 Claims, 6 Drawing Figures

WEB FEEDING OR WINDING-UP APPARATUS

The present invention relates to a web feeding or winding up apparatus suitable for machines working on web such as for example, printing machines, painting machines, coating machines, laminating machines or the like, of the type having two lateral upright supports between which there is rotatably mounted for rotation about a horizontal axis, at least one pair of arms, the ends of which are provided with means for supporting a core onto which a roll of web is to be wound or from which it is to be unwound.

The present invention seeks to provide a device of this type which will operate safely and reliably and which will be economically advantageous.

According to the present invention there is provided, a web feeding or winding up device for machines operating on a web, such as printing machines, painting machines, coating machines, laminating machines or the like, of the kind comprising two lateral uprights between which there is carried, rotatably about a substantially horizontal axis, at least one pair of arms, the ends of which are provided with means for supporting a core for winding up or feeding off a roll of web, in which the free end of at least one arm of the pair is provided with a motor for driving a core carried by the arms to rotate.

Preferably the said arm carrying the motor is hollow and the motor is located within the interior thereof and is provided with means for circulating cooling air within the interior of the arm.

According to further aspect of the invention the means for supporting a core on which a roll of web is then wound, or from which a roll of web is to be unwound, which core consists of a hollow tubular body, comprises a pair of frusto-conical plugs carried one by each arm, at least one of the plugs being axially displaceable so as to fit the core in position or release it for removal.

Another possibility is obtained if the means for supporting a core on which a roll of web is to be wound or from which it is to be unwound, which core consists of a hollow tubular body, comprises a bar having radial support blocks for engaging the interior of the tubular body, one end of the bar having a plurality of radial teeth engageable in splines in a sleeve and the other end of the bar carrying a bearing borne in a housing which is displaceable axially of the bar. It is also possible for the apparatus to be provided with means for adjusting the angular orientation of the device as a whole about a vertical axis.

Two embodiments of the present invention will now be more particularly described by way of example, with reference to the accompanying drawings, in which.

Figure 1:
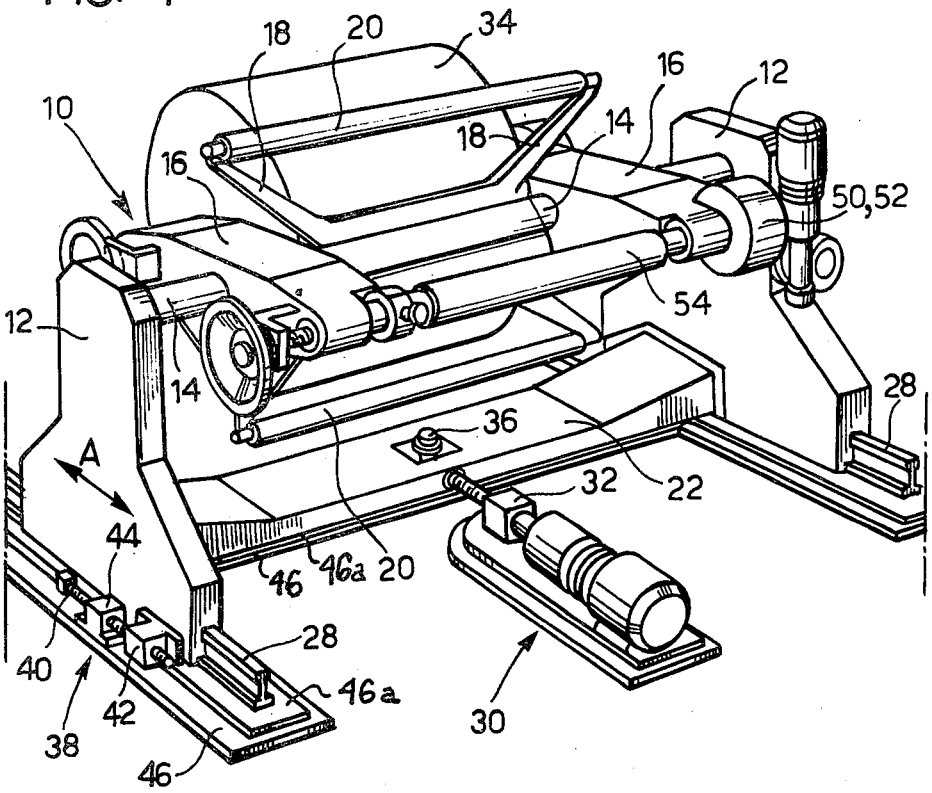
FIG. 1 is a perspective and diagrammatic view of a winding or unwinding device formed as an embodiment of the invention.

Referring now to the drawings, there is shown a device 10 formed as an embodiment of the invention which can serve either as a web feeding device or as winding up apparatus for any web working machine, for example a coating or painting machine or one which spreads liquids, pastes or powders, or a machine for treatment of any material in web form as embossing, cutting, laminating, tapering etc.

The web feeding or winding up device 10 illustrated in FIG. 1 is provided with two lateral upright supports 12 between which there is carried a rotatable shaft 14, on which are mounted two arms 16. The shaft 14 also carries at spaced points intermediate its two ends a pair of smaller arms 18 extending orthogonally in relation to the main arms 16 and bearing at their ends a deflection roller 20.

Figure 3:
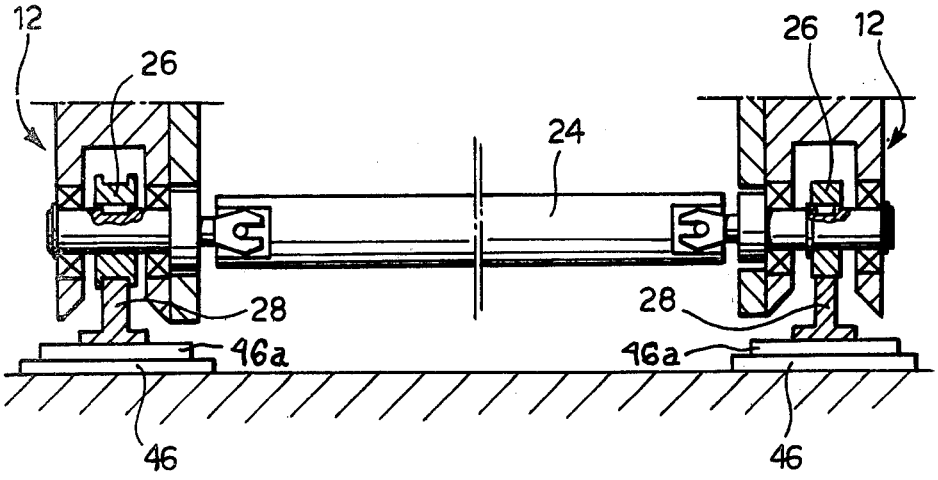
FIG. 3 is a longitudinal section, on an enlarged scale of the lower part of the device which is movable upon a pair of wheels.

The two upright supports 12 are boxed in and connected together by a crosspiece 22 within which is housed a shaft 24 which couples wheels 26 (see FIG. 3). The wheels 26 roll on two parallel rails 28 carried on an upper base 46 for the purpose of effecting movement of the device 10 in the direction of the double arrow A of FIG. 1.

The device 10 is moved along rails 28 by the threaded engagement between cross piece 22 and a threaded shaft which is itself driven by a motor 30 provided with a reduction gearbox 32. Thanks to this displacement system it is possible to adjust the position of a roll 34, for web feed or for winding up, to the desired distance from the first or last working unit of the machine operating on the web.

The device 10 shown in FIG. 1 is mounted on upper base **46*a* which can be turned about a vertical axis 36 passing through the centre of the device 10. This turning movement of upper base 46*a* relative to the fixed lower base 46 is effected by displacement devices 38 known per se; these devices 38 may comprise for example a threaded pin 40 which engages in two bushes carried on a block 42 fixed to the upper base 46*a* and a block 44 fixed to the lower base 46. Because it is possible to adjust the orientation of the whole device 10, the roll 34** can be lined up with its axis exactly perpendicular to the direction of travel of the web through the machine which is to work, or which has worked, on the web.

Figure 2:
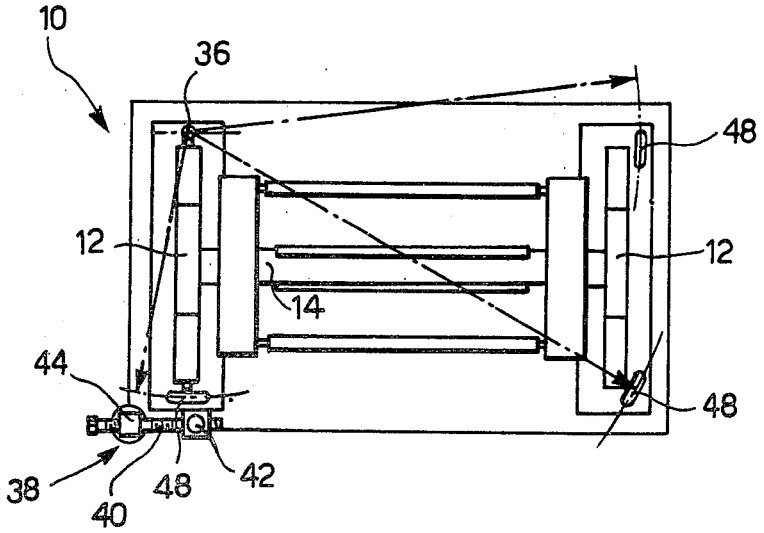
FIG. 2 is a diagrammatic plan view from above of the device shown in FIG. 1 illustrating one type of positional adjustment.

As shown diagrammatically in FIG. 2, the axis 36 about which the device 10 is turnable can also be situated at a corner of the device 10, in this case the other three corners of the device are provided with arcuate guides.

The crosspiece 22 of the device 10 provides a housing for cables and pipes for electric, hydraulic or pneumatic connections between the two boxed-in uprights 12.

Preferably the two arms 16 are also encased or boxed in and the central shaft 14 of the device 10 is hollow inside, this hollow interior space being in communication via two openings, not shown, with the interior of the casings for the arms 16. Within the end of one of the arms 16 there is housed an electric motor 50 and brake 52. The interiors of both arms 16 also provided with means, not illustrated, for the circulation of cooling air; this ensures that good cooling of the motor 50 and the brake 52 is effected, as well as continuously washing with clean air, for flame-proofing purposes, all the electrical, hydraulic or pneumatic connections within the interior of the central shaft 14 and the boxed-in arms 16.

Figure 4:
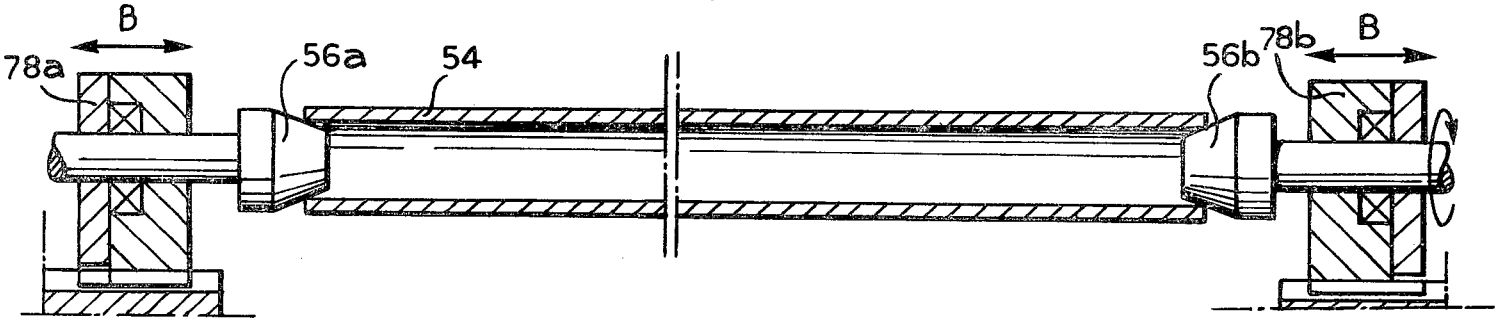
FIG. 4 is a longitudinal section showing the supports for the core.

As shown in FIG. 4, the core 54 of a roll 34 of web consists of a tubular body which, in the example of FIG. 4, is supported between two opposite arms 16 by means of a pair of frusto-conical plugs 56*a*, 56*b*. The plugs 56*a* and 56*b* are rotatably carried in two heads 78*a*, 78*b* which are axially displaceable as shown by the double arrows B. The head 78*b* on the transmission side, that is the one on the right in FIG. 4, is displaceable in the direction of the double arrow B by means of a system of screws and nuts not shown. The opposite head 78*a* is, when the system is assembled, displaced towards the other head 78*b* by means of a fluid pressure actuator (also not shown), so as to press its associated frusto-conical plug 56 constantly against the cylindrical body 54 to ensure perfect engagement of this with the two frusto-conical plugs 56. The head 78*b* on the transmission side is displaced so as to ensure exact alignment of the core 54 in relation to the path of the web through the machine. Extraction of the core 54 is effected by displacing one or both of the frusto-conical plugs 56*a*, 56*b*, away from the core 54 which is then free for removal.

During operation of the device 10 one of the frusto-conical plugs can be driven to rotate by the motor 50 which is operatively connected to the shaft on which this plug 56*b* is carried.

Figure 6:
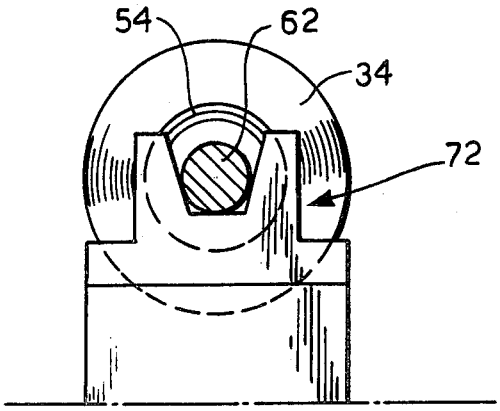
FIG. 6 is a cross section taken on the line VI—VI of FIG. 5.
Figure 5:
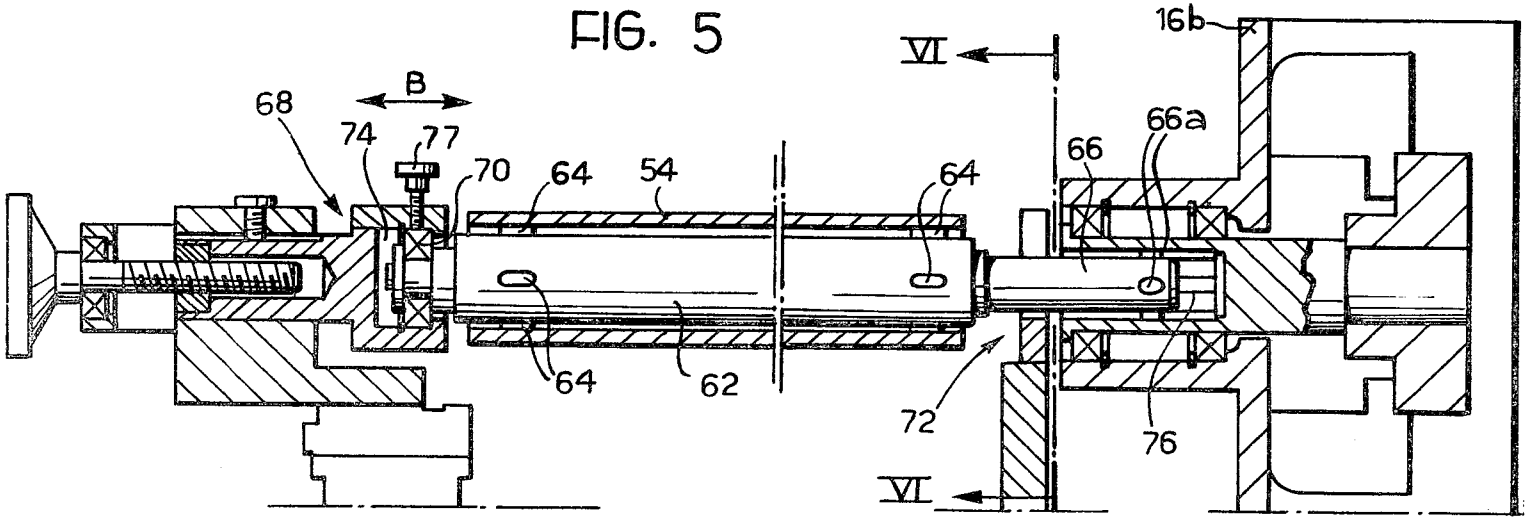
FIG. 5 is a longitudinal section similar to that of FIG. 4 illustrating a second embodiment having a different method for supporting the core.

In the alternative embodiment illustrated in FIGS. 5 and 6 the core 54 is carried by a central bar 62. This bar 62 is provided with two sets of support blocks 64 which extend radially outwardly for engaging the core 54 onto the bar 62. One end 66 of the bar 62 has a plurality of radially outwardly projecting teeth 66*a* while the opposite end 68 of the bar 62 carries a bearing 70.

When the bar 62, carrying the core 54, is being connected to the end of the right hand arm 16 (as viewed in FIG. 5) carrying the motor 50, the end of the bar 62 having the teeth 66*a* rests upon a support 72 having a V-section recess and situated close to the said arm. The other end 68 carrying the bearing 70 is inserted into a housing 74 into which the bearing 70 is then secured, for example by means of a clamping screw 77 as shown in FIG. 5. After this the housing 74, and with it the bar 62, is thrust towards the opposite arm 16*b* which carries an internally splined sleeve 76 for coupling with the teeth 66*a* of the end 66 of the bar 62. In order to accommodate possible small misalignments of the sleeve 76 in relation to the housing 74 which carries the end 68, the teeth 66*a* of the toothed end 66 have a barrel shape in section.

Movement of the end 68 in the direction of the double arrow B serves both for introducing the end 66 of the bar 62 into the sleeve 76, which is connected to the motor 50, and also for adjusting the transverse position of the core, making use of the length of the splines in the sleeve 76 in order to position the core 54 transversely in relation to the path of the web in the machine operating on the web. Likewise displacement of the end 68 to the left in FIG. 5 serves to unload the bar 62 and hence the roll 34 from the arms 16.

The transverse positioning of the core 54 carrying the roll 34 can be adjusted automatically by means of a signal emitted by a photocell or the like device positioned for detecting any possible lateral displacement of the web during operation of the machine.

As is illustrated in FIG. 1 the device 10, in fact, has two pairs of arms 16, extending in opposite directions with respect to each other away from the central shaft 14. Each pair of arms 16 carrying members for supporting a respective core 54 and being adjustable to position the core 54 carried thereby independently in relation to the core 54 carried by the other pair of arms 16.

What is claimed is:

1. In a web feeding or winding up device for use in connection with machines operating on a web, and comprising:

base means, two lateral uprights, at least one pair of arms carried rotatably about a substantially horizontal axis between said two lateral uprights, a hollow tubular core, and means at the ends of said arms for supporting said core for winding up or feeding off a roll of web, the improvement comprising a motor mounted on the free end of at least one arm of said pair of arms for rotating said core carried by said arms about its longitudinal axis, said means for supporting said core comprising:

a bar, radial support blocks on said bar for engaging the interior of said tubular core, a sleeve carried on one of said two arms, means defining internal axial splines on said sleeve, a plurality of radial teeth on one end of said bar engageable in said splines in said sleeve, a bearing housing carried by the other of said two arms, the other end of said bar carrying a bearing supported in said housing, and means for displacing said housing in the axial direction of said bar.

2. A device as in claim 1, wherein adjacent said splined sleeve at said one end of said bar or adjacent said bearing housing at the other end of said bar, there is provided a support having a V-shape recess for receiving and supporting said core whilst it is being fitted to the supports at each end thereof.

3. A device as in claim 1, wherein said radial teeth at the said one end of said bar have a barrel shape cross section.

4. A device as in claim 1, further comprising parallel rails on said base means, wheel means on each lateral upright engaging said rails to permit horizontal displacement of said device and drive means for moving said device along said rails.

* * * * *